US008653346B2

(12) United States Patent
Schaman

(10) Patent No.: US 8,653,346 B2
(45) Date of Patent: Feb. 18, 2014

(54) HARMONICA ADAPTED FOR CHORDAL JAMMING AND METHOD AND USE OF SAME FOR IMPROVING PULMONARY FUNCTION

(76) Inventor: John P. Schaman, Breslau (CA)

( * ) Notice: Subject to any disclaimer, the term of this patent is extended or adjusted under 35 U.S.C. 154(b) by 13 days.

(21) Appl. No.: 13/569,329

(22) Filed: Aug. 8, 2012

(65) Prior Publication Data

US 2013/0036893 A1 Feb. 14, 2013

(30) Foreign Application Priority Data

Aug. 10, 2011 (CA) ..... 2748637

(51) Int. Cl.
*G10D 7/12* (2006.01)

(52) U.S. Cl.
USPC ..... 84/377

(58) Field of Classification Search
None
See application file for complete search history.

(56) References Cited

U.S. PATENT DOCUMENTS 364,610 A * 6/1887 Stratton ..... 84/377
1,676,154 A * 7/1928 Perry ..... 84/377
4,237,766 A * 12/1980 Marshall ..... 84/377
5,166,461 A * 11/1992 Salwitz et al. ..... 84/377
5,413,021 A * 5/1995 Margetson ..... 84/377
7,847,172 B2 * 12/2010 Harrison ..... 84/377
2013/0036893 A1 * 2/2013 Schaman ..... 84/377

FOREIGN PATENT DOCUMENTS

GB 2301697 A * 12/1996

* cited by examiner

*Primary Examiner* — Robert W Horn
(74) *Attorney, Agent, or Firm* — Riches McKenzie & Herbert LLP

(57) ABSTRACT

A harmonica is provided comprising a blow reed plate having a plurality of blow reeds, a draw reed plate having a plurality of draw reeds, and a comb having a plurality of air channels therein, wherein each blow reed and each draw reed corresponds to one of a plurality of musical tones, wherein the plurality of air channels are grouped into a first group of air channels and a second group of air channels, wherein blowing air through a first subset of the first group of air channels produces the musical tones of a first musical chord and drawing air from the first subset of the first group of air channels produces the musical tones of a second musical chord, and wherein blowing air through a first subset of the second group of air channels produces the musical tones of a third musical chord and drawing air from the first subset of the second group of air channels produces the musical tones of a fourth musical chord.

18 Claims, 11 Drawing Sheets

22 26 24

| | | | | | | | | | | | |
|---|---|---|---|---|---|---|---|---|---|---|---|
| Harmonica Key | Low F | | | | | | G | | | | |
| Band Chord | IV Chord (FMaj + Dm7) | | | | | | V Chord (GMaj + Em7) | | | | |
| Blow Chords | F Major | | | | | | G Major | | | | |
| Blow Notes | F | A | C | F | A | | G | B | D | G | B |
| Hole No. | 1 | 2 | 3 | 4 | 5 | | 6 | 7 | 8 | 9 | 10 |
| Draw Notes | G | C | E | G | Bb | | A | D | F# | A | C |
| Draw Chords | C Major | | | | C7 | | D Major | | | | D7 |
| Band Chord | I Chord (CMaj + C7 + Am7) | | | | | | II Chord (DMaj + D7 + Bm7) | | | | |

FIG. 5A 22 26 24

| | | | | | | | | | | | |
|---|---|---|---|---|---|---|---|---|---|---|---|
| Harmonica Key | Low F | | | | | | G | | | | |
| Band Chord | IV Chord (FMaj + F7 + Dm7) | | | | | | V Chord (GMaj + G7 + Em7) | | | | |
| Blow Chords | F Major | | | | F7 | | G Major | | | | G7 |
| Blow Notes | F | A | C | F | Eb | | G | B | D | G | F |
| Hole No. | 1 | 2 | 3 | 4 | 5 | | 6 | 7 | 8 | 9 | 10 |
| Draw Notes | G | C | E | G | Bb | | A | D | F# | A | C |
| Draw Chords | C Major | | | | C7 | | D Major | | | | D7 |
| Band Chord | I Chord (CMaj + C7 + Am7) | | | | | | II Chord (DMaj + D7 + Bm7) | | | | |

FIG. 5B 22 26 24

| | | | | | | | | | | |
|---|---|---|---|---|---|---|---|---|---|---|
| Harmonica Key | Low C | | | | | | Low D | | | |
| Band Chord | IV Chord (CMaj + Am7) | | | | | | V Chord (DMaj + Bm7) | | | |
| Blow Chords | C Major | | | | | | D Major | | | |
| Blow Notes | C | E | G | C | E | | D | F# | A | D | F# |
| Hole No. | 1 | 2 | 3 | 4 | 5 | | 6 | 7 | 8 | 9 | 10 |
| Draw Notes | D | G | B | D | F | | E | A | C# | E | G |
| Draw Chords | G Major | | | | G7 | | A Major | | | | A7 |
| Band Chord | I Chord (GMaj + G7 + Em7) | | | | | | II Chord (AMaj + A7 + F#m7) | | | | |

FIG. 6A 22 26 24

| | | | | | | | | | | |
|---|---|---|---|---|---|---|---|---|---|---|
| Harmonica Key | Low C | | | | | | Low D | | | |
| Band Chord | IV Chord (CMaj + C7 + Am7) | | | | | | V Chord (DMaj + D7 + Bm7) | | | |
| Blow Chords | C Major | | | | C7 | | D Major | | | D7 |
| Blow Notes | C | E | G | C | Bb | | D | F# | A | D | C |
| Hole No. | 1 | 2 | 3 | 4 | 5 | | 6 | 7 | 8 | 9 | 10 |
| Draw Notes | D | G | B | D | F | | E | A | C# | E | G |
| Draw Chords | G Major | | | | G7 | | A Major | | | | A7 |
| Band Chord | I Chord (GMaj + G7 + Em7) | | | | | | II Chord (AMaj + A7 + F#m7) | | | | |

FIG. 6B 22 26 24

| | | | | | | | | | | | |
|---|---|---|---|---|---|---|---|---|---|---|---|
| Harmonica Key | A | | | | | | B | | | | |
| Band Chord | IV Chord (AMaj + F#m7) | | | | | | V Chord (BMaj + G#m7) | | | | |
| Blow Chords | A Major | | | | | | B Major | | | | |
| Blow Notes | A | C# | E | A | C# | | B | D# | F# | B | D# |
| Hole No. | 1 | 2 | 3 | 4 | 5 | | 6 | 7 | 8 | 9 | 10 |
| Draw Notes | B | E | G# | B | D | | C# | F# | A# | C# | E |
| Draw Chords | E Major | | | | E7 | | F# Major | | | | F#7 |
| Band Chord | I Chord (EMaj + E7 + C#m7) | | | | | | II Chord (F#Maj + F#7 + D#m7) | | | | |

FIG. 7A 22 26 24

| | | | | | | | | | | | |
|---|---|---|---|---|---|---|---|---|---|---|---|
| Harmonica Key | A | | | | | | B | | | | |
| Band Chord | IV Chord (AMaj + A7 + F#m7) | | | | | | V Chord (BMaj + B7 + G#m7) | | | | |
| Blow Chords | A Major | | | | A7 | | B Major | | | | B7 |
| Blow Notes | A | C# | E | A | G | | B | D# | F# | B | A |
| Hole No. | 1 | 2 | 3 | 4 | 5 | | 6 | 7 | 8 | 9 | 10 |
| Draw Notes | B | E | G# | B | D | | C# | F# | A# | C# | E |
| Draw Chords | E Major | | | | E7 | | F# Major | | | | F#7 |
| Band Chord | I Chord (EMaj + E7 + C#m7) | | | | | | II Chord (F#Maj + F#7 + D#m7) | | | | |

FIG. 7B

HARMONICA ADAPTED FOR CHORDAL JAMMING AND METHOD AND USE OF SAME FOR IMPROVING PULMONARY FUNCTION

FIELD OF THE INVENTION

This invention relates to a harmonica with an altered configuration, and more particularly to a harmonica and method of playing same, operable to improve the pulmonary function of a user.

BACKGROUND OF THE INVENTION

Harmonicas are well known in the art as a popular musical instrument. A player is able to produce sound, including musical tones, by "blowing" (exhaling) or "drawing" (inhaling) air into the harmonica to vibrate one or more reeds located within the instrument. It is one of few wind instruments, if not the only wind instrument, that is played or that produces sound during both the inhalation and exhalation phases of breathing. Accordingly, playing the harmonica requires a great deal of lung control from the harmonica player in order to produce strong, clear tones. This can include strong breathing, as extended harmonica playing requires a certain level of lung strength and capacity.

Generally speaking, there are a few different types of harmonicas which have been designed and used for different playing purposes. These include diatonic harmonicas, chromatic harmonicas, chord harmonicas and bass harmonicas.

Diatonic harmonicas are by far the most common and least expensive harmonicas in use today. Most have 10 holes and use Richter tuning. Each hole has a blow and a draw reed that, when tuned to the key of C Major, essentially plays the equivalent of the "white keys" of a piano. For example, a common note diagram for a conventional 10-note harmonica in the Key of C is shown in Table 1.

TABLE 1

Note diagram for a conventional diatonic harmonica

| | | | | | | | | | | |
|---|---|---|---|---|---|---|---|---|---|---|
| Blow notes | C | E | G | C | E | G | C | E | G | C |
| Draw Notes | D | G | B | D | F | A | B | D | F | A |
| Hole No. | 1 | 2 | 3 | 4 | 5 | 6 | 7 | 8 | 9 | 10 |

Chromatic harmonicas are more expensive and more complicated than diatonic harmonicas. Chromatic harmonicas have a button at one end that allows a different reed to enter both the blow or draw path when the button is pressed. Chromatic harmonicas are tuned to allow the player to play a chromatic scale (i.e. both the white keys and the black keys) of a piano within a certain range.

Chord harmonicas are configured to allow a player to play chords, or combinations of three or more notes (pitches). Chord harmonicas are very large, generally expensive, and uncommon. However, they are operable to allow a user to play multiple chords.

Chord harmonicas are longer than the other configurations of harmonicas and typically involve a type of mouthpiece which leads to at least three or more reeds to play each chord. Blowing or drawing on a designated area of a chord harmonica results in playing a particular chord. It is not possible to play the individual notes of each chord with a chord harmonica and all notes of the chord sound when either blowing or drawing. Furthermore, it is common to have 48 different chords available on a chord harmonica.

Bass harmonicas are typically uncommon and expensive. They allow a user to play very low-pitched bass notes. Furthermore, bass harmonicas typically are only played when blowing air through the harmonica and not when drawing air.

Referring to FIG. 1A, a conventional diatonic harmonica 1 is shown in an exploded view. The conventional diatonic harmonica 1 is made of five main layers including a cover plate 2, a blow reed plate 3, a body plate 4 (or comb), a draw reed plate 5 and a bottom cover plate 6. The five layers are mechanically coupled by coupling means 7. For example, a number of nuts and bolts may be used.

Looking at the blow reed plate 3 and the draw reed plate 5, a plurality of slots are shown to which metal reeds may be attached. Longer slots, corresponding to longer reeds, are for lower tones; while shorter slots and therefore shorter reeds, are for higher tones. As shown in FIG. 1A, conventional diatonic harmonicas 1 are configured such that the lowest tone or pitch starts on the left and progressively gets higher from left to right.

Referring now to FIG. 1B, a conventional diatonic harmonica 1 is shown in an isometric view. As assembled, the blow reed plate 3 and the draw reed plate 5 form a plurality of air channels 8 within the comb (body plate) 4. A plurality of channel dividers 9 separates each of the air channels 8 from one another. Air is then blown in or drawn from each air channel 8 vibrating the corresponding reed attached to the blow reed plate 3 or the draw reed plate 5, respectively. Each air channel 8 corresponds to a specific tone, which is typically configured according to Richter tuning corresponding to lower tones on the left progressing to higher tones on the right. Furthermore, as shown in FIG. 1B, the channel dividers 9 are equally spaced and equally wide along the width of the conventional diatonic harmonica 1.

As mentioned, because a harmonica requires breathing control during both the blowing and drawing phases, it is an ideal instrument or tool for improving or rehabilitating the pulmonary system. Pulmonary or lung function is becoming increasingly important as the world's population ages. Epidemiological data reveals a 50% loss in lung function between the ages of 30 and 70. However, although it is normal to observe a decline in lung function as a person ages, it may not be desirable or optimal for good health and longevity.

Medical testing has improved dramatically in the area of pulmonary function. Tests have been developed to measure lung function and doctors are seeing increasing number of patients as the aging population swells. Long-term observations in clinical practice reveals that a rather significant proportion of patients who undergo pulmonary function testing are actually significantly below the statistical norm, taking into account individual variances due to age, sex, ethnicity, and height. While physical activity is often prescribed, clinical medical practice and observation in exercise physiology has revealed that aerobic endurance exercise prescribed for cardiac rehabilitation patients and advised for general fitness does not significantly benefit pulmonary function, even though it results in marked improvement in general fitness and heart function. Accordingly, it is generally accepted by medical and exercise physiology experts that general exercise does little to improve lung fitness and function.

While it might be concluded that a certain amount of lung function is lost during the aging process, observation has shown that individuals of different ages partaking in specific, identified activities have shown less of a decline in lung function compared to individuals who do not partake in such activities. For example, it has been shown or is commonly believed that activities such as horn playing, opera singing, breath-hold diving or free-diving, and the like, reduce the decline in lung function or even improve lung function when consistently undertaken. Accordingly, engaging in certain lung activities may be able to reduce the loss of lung function that is normally seen with aging. Specifically, reports from several North American and international pulmonary rehabilitation programs have suggested that harmonica playing may have pulmonary benefits.

However, conventional harmonicas have been found to be less than ideal when brought into clinical practice. Because traditional harmonica playing typically involves playing melodies, tunes, and riffs, clinical patients are typically taught to play scales and melodies. This is similar to the way most books and teaching methods advocate, with the harmonica as the lead instrument. Unfortunately, many clinical patients were frustrated by this technique, as beginning harmonica players, and particularly older patients, found it difficult to play single notes or tones, which requires advanced breathing and air flow control using a player's mouth and/or tongue. Furthermore, playing individual notes didn't result in the expected pulmonary benefits, as playing single tones was not challenging enough to the pulmonary system to produce the expected or desired results.

Finally, while it was appreciated that simply blowing and drawing strongly across a plurality of contiguous air channels required a greater pulmonary "effort", resulting in a more challenging and beneficial exercise to the pulmonary system, it resulted in a loss of musicality. Specifically, making this noise by simply blowing or drawing across a plurality of air channels, rather than creating single notes, melodies, or music, removed much of the fun and desirability of playing the harmonica. As a result, compliance to a harmonica therapy regimen suffered.

Accordingly, there is a need for a harmonica that allows for playing notes and/or music that is physiologically challenging and effective to the pulmonary system to offset the reduction in lung function due to aging and other causes. Furthermore, there is a need for such a harmonica to be easy to play, especially for older harmonica players and players undergoing pulmonary rehabilitation. In addition, there is a need for such a harmonica and method of playing such a harmonica to be fun and to maintain a sense of musicality and desirability in order to improve and maintain compliance of a harmonica playing regimen.

SUMMARY OF THE INVENTION

It is an object of this invention to overcome at least some of the deficiencies of the prior art. Furthermore, it is an object of this invention to provide a harmonica that is easy to play, easy to learn, and which provides the pulmonary challenges felt to be required to achieve the benefits of increased lung function when used and played consistently. In addition, it is an object of this invention to provide a method for improving or maintaining pulmonary function in aging adults by strengthening the muscles of respiration, including the diaphragm, exercising the lungs above the comfort zone in the inspiratory range and exercising the lungs below the comfort zone in the expiratory range.

Typical diatonic harmonicas are generally arranged according to a musical scale, ie., sequentially from low notes on one end of the harmonica to high notes on the opposite end. However, in the preferred embodiments of the present invention, the harmonica is organized into musical chords when air is blown into or drawn from a series of contiguous air channels. Furthermore, the harmonica of the present invention maintains the ability to play individual notes, when playing a melody or note pattern is desired.

The present invention is directed to a harmonica that rearranges the notes on a conventional diatonic harmonica such that at least four distinct chords can be easily played by the harmonica player, while at the same time maintaining the capability of playing individual notes. The chords comprise blowing into or drawing air from a series of contiguous air channels. In this manner, the harmonica player can utilize the harmonica to play songs and rhythms using chord progressions, rather than simply relying on the melodies typically played on a conventional diatonic harmonica. Such harmonica playing has been termed "Chordal Jamming". A harmonica configured for Chordal Jamming may be easily learned by individuals of all ages. Furthermore, a harmonica configured for Chordal Jamming maintains the fun and musicality of playing the harmonica while providing a significant physiological challenge such that it may be used in therapy for possible pulmonary and other health benefits.

While a conventional diatonic harmonica is most often a lead instrument, playing the melody or harmony in a song, a harmonica configured for Chordal Jamming may be used to provide "the background music" instead of the melody. In other words, a harmonica configured for Chordal Jamming is operable as the chording instrument. In this manner, the harmonica becomes an instrument similar to the rhythm guitar or the organ in the band. Such an adaptation maintains a similar size to a conventional diatonic harmonica and may be manufactured for a comparable price in a similar price range.

In developing a harmonica configured for Chordal Jamming, it was appreciated that the conventional diatonic harmonica actually plays two chords; one while blowing and one while drawing. However, with only two chords, the variety in songs and musicality is limited. Accordingly, by rearranging the placement of notes within the harmonica, a harmonica configured for Chordal Jamming is able to play chord progressions for a greater variety of music and musical genres.

In one aspect, the present invention resides in a harmonica comprising: a blow reed plate comprising a plurality of blow reed cells therein, wherein each blow reed cell is arranged on the blow reed plate and comprises a blow reed and a blow reed slot; a draw reed plate comprising a plurality of draw reed cells therein, wherein each draw reed cell is arranged on the draw reed plate and comprises a draw reed and a draw reed slot; a comb having a plurality of air channels therein, said comb positioned between the blow reed plate and the draw reed plate, wherein each of the plurality of air channels comprises a first side adjacent to one of the plurality of blow reed cells and a second side adjacent to one of the plurality of draw reed cells; and a housing comprising a top cover plate and a bottom cover plate, wherein the blow reed plate, the draw reed plate and the comb are disposed within the housing; wherein each blow reed cell and each draw reed cell corresponds to one of a plurality of musical tones, wherein the plurality of air channels are grouped into a first group of air channels (holes 1 to 5) and a second group of air channels (holes 6 to 10), wherein blowing air through a first subset of the first group of air channels (holes 1 to 5) produces the musical tones of a first musical chord and drawing air from the first subset of the first group of air channels (holes 1 to 5) produces the musical tones of a second musical chord, and wherein blowing air through a first subset of the second group of air channels (holes 6 to 10) produces the musical tones of a third musical chord and drawing air from the first subset of the second group of air channels (holes 6 to 10) produces the musical tones of a fourth musical chord.

In another aspect, the present invention resides in a method of improving pulmonary function in a pulmonary system comprising: providing a harmonica comprising a first plurality of air channels (holes 1 to 5) and a second plurality of air channels (holes 6 to 10), wherein blowing air through a first subset of the first plurality of air channels (holes 1 to 5) produces a first musical chord, wherein drawing air from the first subset of the first plurality of air channels (holes 1 to 5) produces a second musical chord, wherein blowing air through a first subset of the second plurality of air channels (holes 6 to 10) produces a third musical chord, and wherein drawing air from the first subset of the second plurality of air channels (holes 6 to 10) produces a fourth musical chord; blowing and drawing air at different times into the harmonica to play music composed of the first musical chord, the second musical chord, the third musical chord and the fourth musical chord; exerting an effective amount of energy by the blowing and drawing of air into the harmonica at different times to strengthen the pulmonary function of the pulmonary system. Furthermore, in preferred embodiments, the method includes exerting energy by the blowing and drawing of air into the harmonica at the different times to strengthen the pulmonary function of the pulmonary system.

Further and other features of the invention will be apparent to those skilled in the art from the following detailed description of the embodiments thereof.

BRIEF DESCRIPTION OF THE DRAWINGS

Reference may now be had to the following detailed description taken together with the accompanying drawings in which:

FIG. 5A and FIG. 5B show musical note configuration tables for a harmonica configured to play in C Major when played in second position, in accordance with an embodiment of the present invention;

FIG. 6A and FIG. 6B show musical note configuration tables for a harmonica configured to play in G Major when played in second position, in accordance with an embodiment of the present invention; and FIG. 7A and FIG. 7B show musical note configuration tables for a harmonica configured to play in E Major when played in second position, in accordance with an embodiment of the present invention.

DETAILED DESCRIPTION OF THE PREFERRED EMBODIMENTS

Figure 1A:
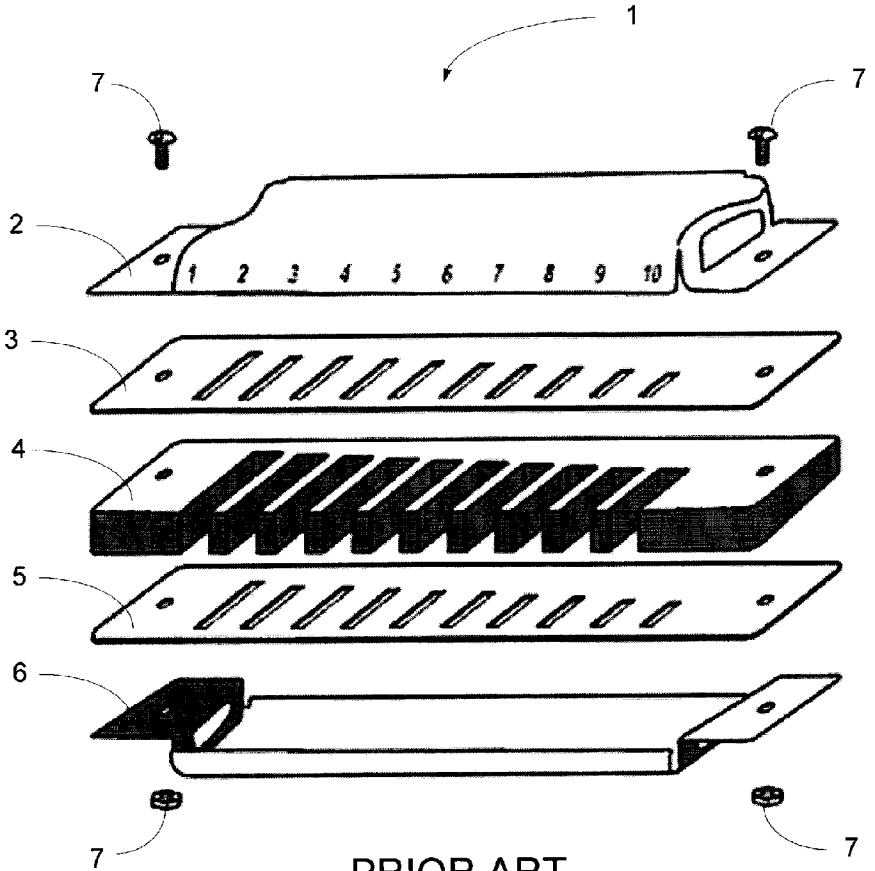
PRIOR ART FIG. 1A
FIG. 1A shows an exploded view of a conventional diatonic harmonica.
Figure 1B:
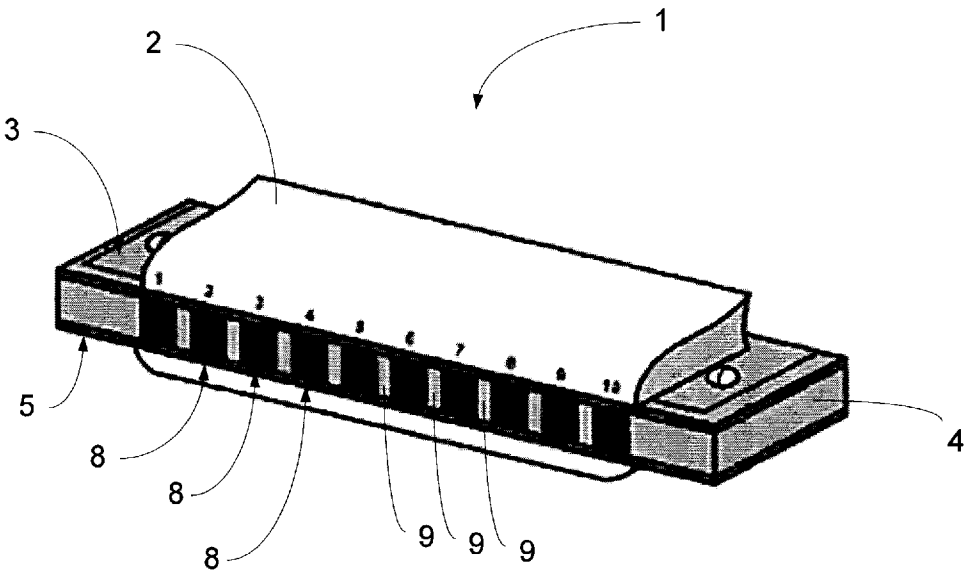
PRIOR ART FIG. 1B
FIG. 1B shows an isometric view of a conventional diatonic harmonica.
Figure 2:
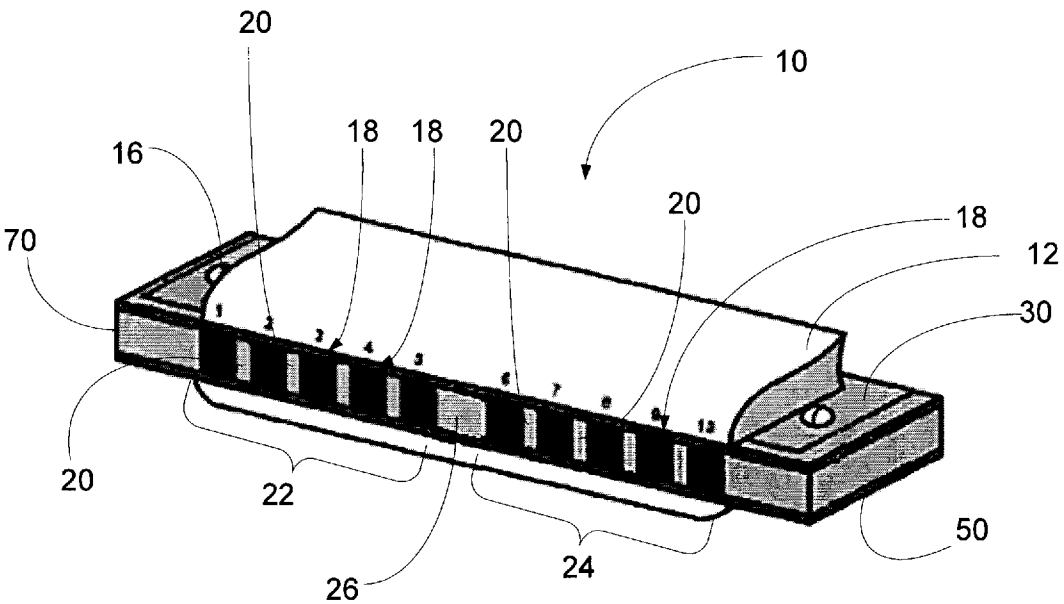
FIG. 2 shows a harmonica in accordance with an embodiment of the present invention.

Referring now to FIG. 2, a harmonica 10 is shown in accordance with an embodiment of the present invention. The harmonica 10 includes a top cover plate 12, a bottom cover plate 14, a blow reed plate 30, a draw reed plate 50, and a comb 70. A housing is formed between the top cover plate 12 and the bottom cover plate 14 with the blow reed plate 30, the draw reed plate 50, and the comb 70 disposed within the housing. Attachment means 16 may be included to mechanically couple the harmonica 10 together. For example, screws, nuts and bolts such as made from stainless steel, rivets, and the like may be used.

The harmonica 10 may have a plurality of air channels 18 formed within the comb 70. Each of the air channels are separated from one another by channel dividers (i.e. teeth) 20, which are part of the comb 70. Each air channel 18 is configured to play a distinct musical note or pitch when air is blown into the air channel 18 and when air is drawn from the air channel 18. Accordingly each air channel 18 is operable to play two distinct notes.

In an embodiment of the present invention, the plurality of air channels 18 are grouped into a first group (holes 1 to 5) 22 and a second group (holes 6 to 10) 24. Furthermore, in a preferred embodiment, the first group 22 and the second group 24 are separated by a group divider 26. The group divider 26 has a width greater than a width of the channel dividers 20 (also termed 'teeth of the comb') and in a preferred embodiment is the equivalent width of two channel dividers 20 plus one air channel 18. Preferably, each air channel 18 is 4.5 mm and each channel divider 20 (tooth of the comb 70) is 3.5 mm. In other embodiments, the air channels 18 may be 5 mm and each channel divider 20 may be 3 mm.

Each of the air channels 18 within the first group 22 (holes 1 to 5) is contiguous, or aligned in series. Similarly, each of the air channels 18 within the second group 24 (holes 6 to 10) is also contiguous, or sequentially adjacent with the next air channel 18. As shown in FIG. 2 (and also in FIG. 3A, FIG. 3B, FIG. 3C and FIG. 3D), each of the air channels 18 within the harmonica 10, or corresponding component, are labelled 1 to 10. These 10 notes correspond to the general air channel numbering (i.e. Hole. No.) of a 10-note diatonic harmonica, as known to a person skilled in the art.

Referring now to FIG. 3A to FIG. 3E, the top cover plate 12, the blow reed plate 20, the draw reed plate 40, and the comb (body plate) 40 are illustrated in further detail.

Figure 3A:
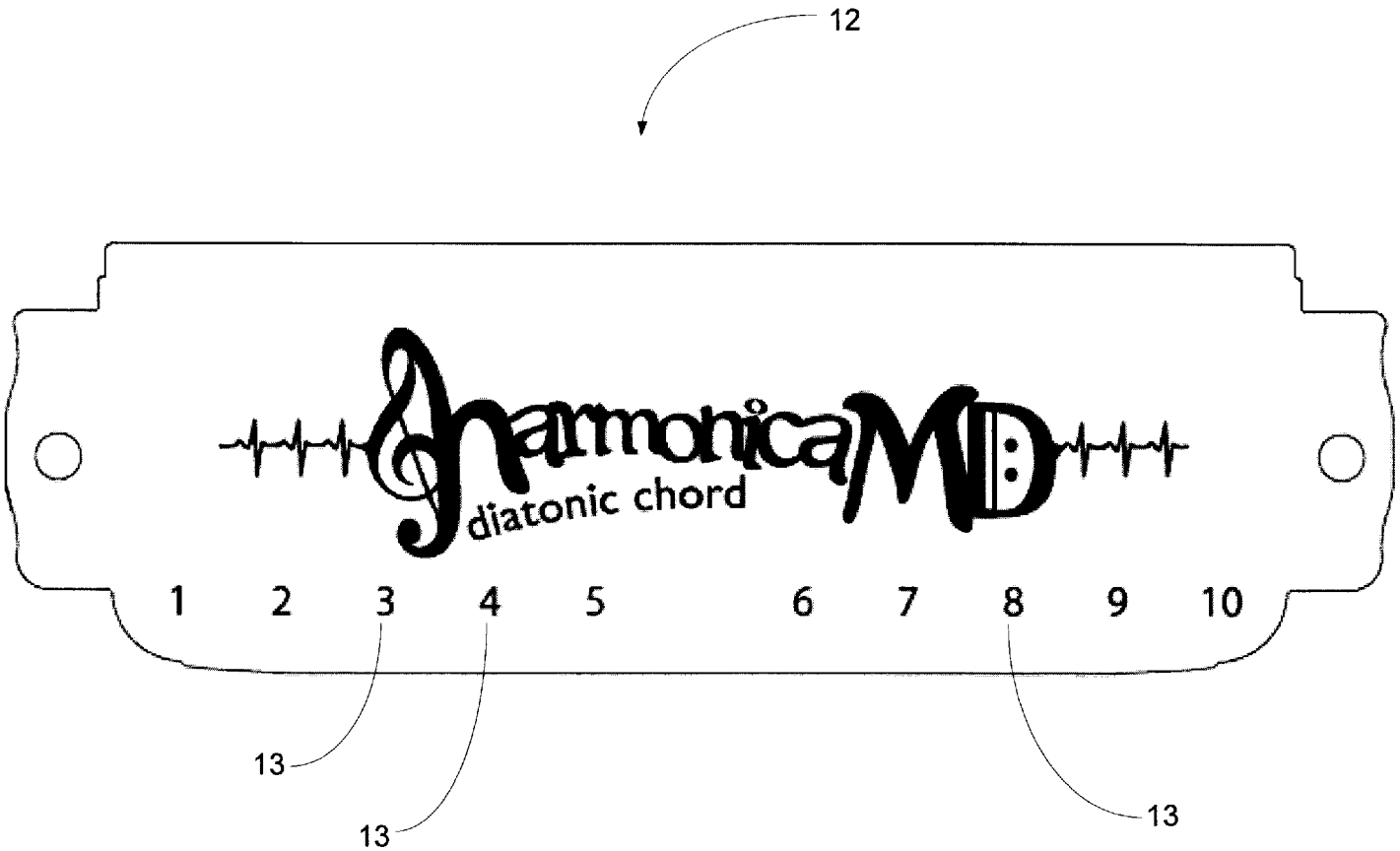
FIG. 3A shows a top view of a cover plate of a harmonica in accordance with an embodiment of the present invention.

The top cover plate 12 shown in FIG. 3A forms part of the housing of the harmonica 10. Indicia 13 may be included to identify the air channel 18 disposed underneath the indicia 13. In some embodiments, the indicia 13 may merely number the air channel 18, as shown in FIG. 3A. In other embodiments, other forms of indicia 13 or labelling of the harmonica 10 may be used. For example, the indicia 13 may label the chords or the notes of the harmonica 10.

Figure 3B:
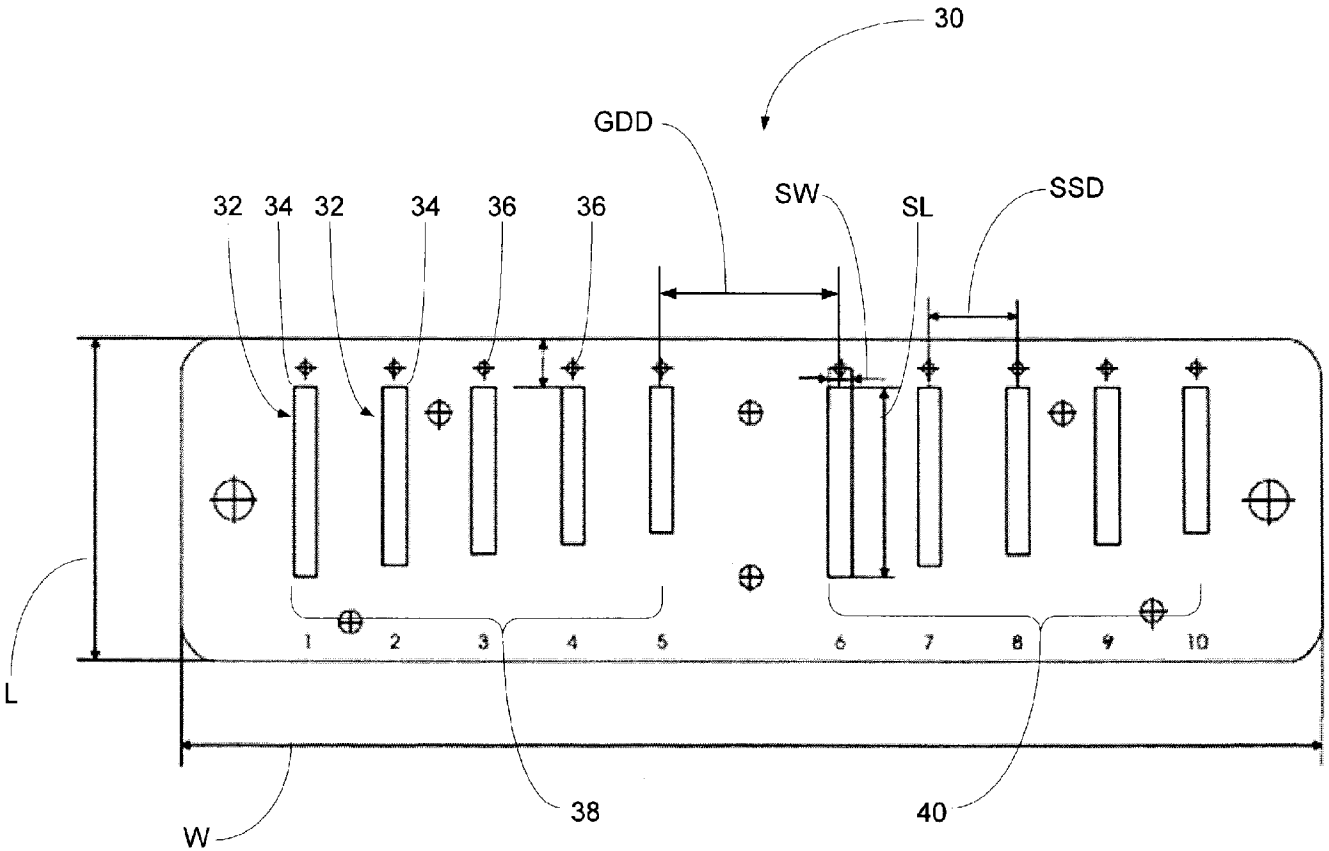
FIG. 3B shows a top view of a draw reed plate of a harmonica in accordance with an embodiment of the present invention.

The blow reed plate 30 is shown in FIG. 3B. The blow reed plate 30 may have a length L and a width W. The blow reed plate 30 is configured with a plurality of blow reed cells 32 arranged on the blow reed plate 30. For example, in the embodiment shown in FIG. 3B, the harmonica 10 has 10 blow reed cells 32. Each blow reed cell 32 is configured with a blow reed slot 34 and a blow reed (not shown) disposed over the blow reed slot 34. Each blow reed may be attached to the blow reed plate 30 by a blow reed attachment means 36. For example, a rivet and the like may be used. Other attachment means 36 may be used to mechanically couple the blow reed to the blow reed plate 30.

In a preferred embodiment, each blow reed is constructed out of metal. For example, the metal reeds may be made of brass, stainless steel, and the like.

The blow reed slot 34 is configured as an aperture in the blow reed plate 30 with a blow reed slot width SW and a blow reed slot length SL. The blow reed is configured to vibrate at a predetermined frequency when air is blown into the respective air channel 18 of the harmonica 10 corresponding to the blow reed slot 34 and the blow reed to produce a musical tone (or note). The musical tone produced by blowing air into the respective air channel 18 is related to the blow reed slot width SW and the blow reed slot length SL and the dimensions of the blow reed itself, as known to persons skilled in the art. Accordingly, each of the plurality of blow reed cells 32 may correspond to a different tone, as the blow reed slot length SL varies from one blow reed cell 32 to another.

As shown in FIG. 3B, the plurality of blow reed cells 32 are grouped into a first group 38 (holes 1 to 5) of blow reed cells 32 and a second group 40 (holes 6 to 10) of blow reed cells 32. The blow reed cells 32 within the first group 38 are separated from one another by a slot spacing distance SSD. Similarly, the blow reed cells 32 within the second group 40 are also separated from one another by the slot spacing distance SSD. As seen in a preferred embodiment, both the first group 38 and the second group 40 progress from lower notes to higher notes (i.e. notes 1 to 5 progress from low to high and notes 6 to 10 progress from low to high). However, other arrangements are possible.

In a preferred embodiment, the first group 38 and the second group 40 are furthermore separated from each other. A group dividing distance GDD may separate the first group 38 from the second group 40. The group dividing distance GDD may be greater than the slot spacing distance SSD. For example, if the blow reed slots 34 are separated by each other with a slot spacing distance SSD of 8 mm in a preferred embodiment, the group dividing distance GDD may be 16 mm.

Figure 3C:
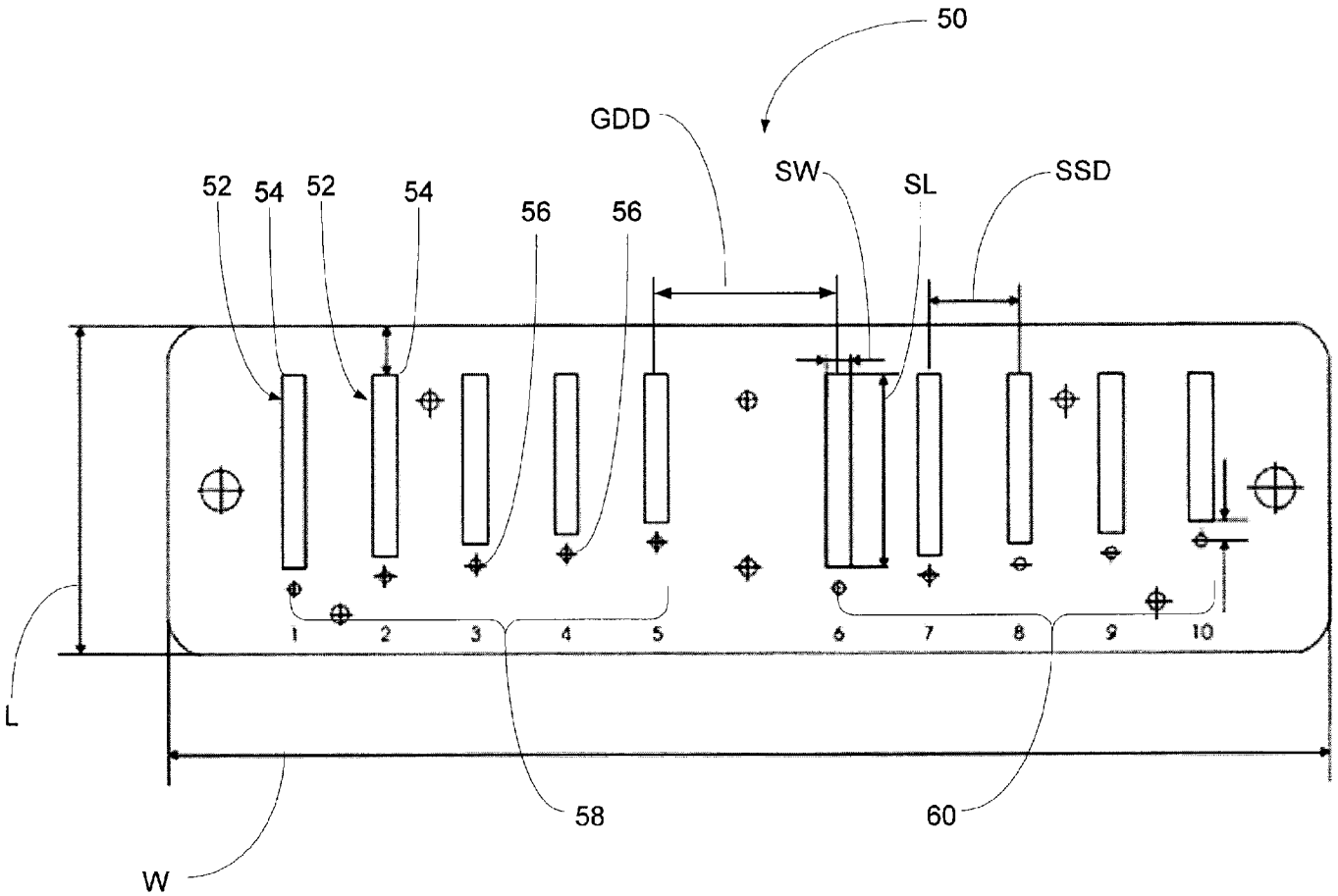
FIG. 3C shows a top view of a blow reed plate of a harmonica in accordance with an embodiment of the present invention.

The draw reed plate 50 is shown in FIG. 3C. The draw reed plate 50 may have similar dimensions to the blow reed plate 30, with a length L and a width W. The draw reed plate 50 is configured with a plurality of draw reed cells 52 arranged on the draw reed plate 50. Each draw reed cell 52 is configured with a draw reed slot 54 and a draw reed (not shown) disposed over the draw reed slot 54. Each draw reed may be attached to the draw reed plate 50 by a draw reed attachment means 56. As with the blow reed plate 30, a rivet and the like may be used. It should be understood that the location of the attachment means (i.e. blow reed attachment means 36 or draw reed attachment means 56) may determine whether a reed cell is a blow reed cell 32 or a draw reed cell 52.

The draw reed slot 54 is configured as an aperture in the draw reed plate 50 with a draw reed slot width SW and a draw reed slot length SL. Similar to the blow reed, the draw reed is configured to vibrate at a specified frequency when air is drawn from the respective air channel 18 of the harmonica 10 corresponding to the draw reed slot 54 and blow reed to produce a musical tone. As with the blow reed plate 30, the musical tone produced by drawing air from the respective air channel 18 is related to the draw reed slot width SW and the draw reed slot length SL and the dimensions of the draw reed itself. Accordingly, each of the plurality of draw reed cells 52 may correspond to a different tone, as the draw reed slot length SL varies from one draw reed cell 52 to another.

Referring to the slot numbering seen in FIG. 3B and FIG. 3C, Table 2 illustrates the blow/draw reed slot length SL and blow/draw slot width SW for the blow reed plate 30 and draw reed plate 50, in a preferred embodiment:

TABLE 2

Blow/Draw Slot Lengths (SL) and Widths (SW)

| Hole No. | Blow/Draw Slot Length SL (mm) | Blow/Draw Slot Width SW (mm) |
|---|---|---|
| 1 | 16.75 | 2.12 |
| 2 | 15.70 | 2.12 |
| 3 | 14.70 | 2.12 |
| 4 | 13.75 | 2.12 |
| 5 | 12.75 | 2.12 |
| 6 | 16.75 | 2.12 |
| 7 | 15.70 | 2.12 |
| 8 | 14.70 | 2.12 |
| 9 | 13.75 | 2.12 |
| 10 | 12.75 | 2.12 |

As seen in Table 2, the slots lengths SL for Hole No. 1 to 5 repeat for Hole No. 6 to 10 for the slots 34, 54 in both the blow reed plate 30 and the draw reed plate 50. Furthermore, the slot widths SW for all the slots 34, 54 are the same in a preferred embodiment.

As shown in FIG. 3C, the plurality of draw reed cells 52 are grouped into a first group 58 of draw reed cells 52 and a second group 60 of draw reed cells 52. The draw reed cells 52 within the first group 58 are separated from one another by a slot spacing distance SSD. Similarly, the draw reed cells 52 within the second group 60 are also separated from one another by the slot spacing distance SSD. In a preferred embodiment, the slot spacing distance SSD is the same in both the blow reed plate 30 and the draw reed plate 50.

Also in a preferred embodiment, the first group 58 and the second group 60 are furthermore separated from each other. The same group dividing distance GDD seen in the blow reed plate 30 may separate the first group 58 from the second group 60. For example, in the same preferred embodiment discussed with the blow reed plate 30, when the draw reed slots 54 of the draw plate 50 are separated by each other with the slot spacing distance SSD of 8 mm, the group dividing distance GDD may be 16 mm.

Figures 3D, 3E:
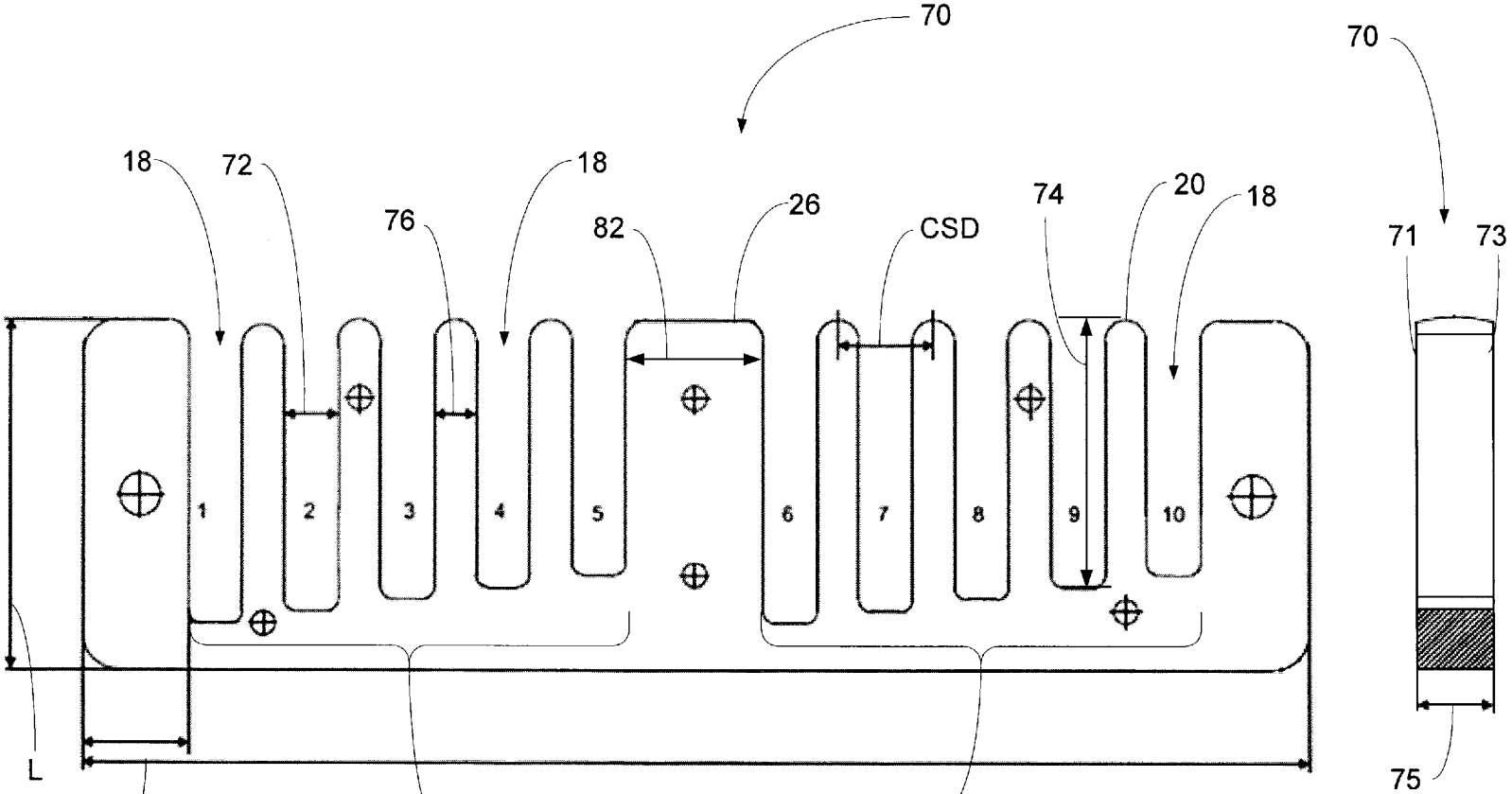
FIG. 3D shows a bottom view of a comb (body plate) of a harmonica in accordance with an embodiment of the present invention.
FIG. 3E shows a side (end) view of a comb (body plate) of a harmonica in accordance with an embodiment of the present invention.

Referring now to FIG. 3D and FIG. 3E, the comb 70 (or body plate) is shown in a preferred embodiment. The comb 70 is configured with a body length L and a body width W. Referring briefly to FIG. 3E, the comb 70 has a first side 71, a second side 73, and a thickness 75. In a preferred embodiment, the thickness of the comb 70 is 6 mm. In some embodiments, the naming of the first side 71 and the second side 73 may be interchangeable as the harmonica 10 may be configured with the blow reed plate 30 and the draw reed plate 50 on either, but opposite, sides 71, 73, as long as Hole No. 1 of each reed plate 30, 50 lines up with Hole No. 1 (i.e. air channel 18) of the comb 70 and the blow reed plate 30 is on top of the comb 70 and the draw reed plate 50 is on the bottom.

As seen in FIG. 3D, the comb 70 is configured with a plurality of air channels 18. Each air channel is configured with a channel width 72 and a channel length 74. While in the preferred embodiment seen in FIG. 3D, the channel width 72 is constant amongst the plurality of air channels, the channel length 74 varies from one air channel to another.

As also seen in FIG. 3D, the plurality of air channels 18 are grouped in to a first group 22 of air channels 18 and a second group 24 of air channels 18. The air channels within the first group 22 are contiguous and are separated from one another by a channel divider 20 having a divider width 76 and a channel spacing distance CSD. Similarly, the air channels 18 within the second group 24 are also contiguous and separated from one another by channel dividers 20 (teeth of the comb) and the channel spacing distance CSD. It should be understood that the channel spacing distance CSD is equal to the channel width 72 and the divider width 76.

Also in a preferred embodiment, the first group 22 and the second group 24 of air channels 18 are furthermore separated from each other by a group divider 26 having a group divider width 82. For example, in the same preferred embodiment discussed with the blow reed plate 30 and the draw reed plate 50 seen in FIG. 3B and FIG. 3C, respectively, the group divider width 82 may be about 11.5 mm. In other embodiments, the group divider width 82 may be at least 10 mm. Furthermore, as also seen, the air channels 18 in the first group 22 of air channels 18 are equally spaced, as are the air channels 18 in the second group 24 of air channels 18.

As the group divider width 82 is less than the group dividing distance GDD with respect to the blow reed plate 30 and the draw reed plate 50, the air channels 18 adjacent to the group divider 26 may provide some clearance between the blow reed cells 32 and the group divider 26 and the draw reed cells 52 and the group divider 26. In a preferred embodiment, the channel width 72 is 4.5 mm, the divider width 76 is 3.5 mm, and the slot width SW is 2.12 mm.

As previously described, the top cover plate 12 and the bottom cover plate 14 form a housing. Within the housing, comb 70 is positioned between the blow reed plate 30 and the draw reed plate 50. For each of the air channels 18 within the comb 70, a corresponding blow reed cell 32 is centred over the first side 71 of the air channel 18 and a corresponding draw reed cell 52 is centred over the second side 73 of the air channel 18.

As shown in the preferred embodiment illustrated in FIG. 3A to FIG. 3E, the harmonica 10 is configured with 10 air channels 18 having a corresponding blow reed cell 32 and draw reed cell 52 on either of the first side 71 and second side 73, respectively. The air channels 18 are labelled as Hole Nos. 1 to 10. Accordingly, the harmonica 10 is operable to produce 20 musical notes. As further shown, the air channels 18 are grouped into a first group 22 of air channels 18 and second group 24 of air channels 18, with five air channels 18 on either side of the group divider 26. The five air channels 32 on either side of the group divider 26 correspond to 10 musical tones.

The harmonica 10 of the present invention is organized into musical chords by blowing air into at least three contiguous air channels 18 or drawing air from at least three contiguous air channels 18 at the same time. Hereinafter, a musical chord is considered to be a collection of at least three notes in a musical key, played at the same time, as known to musicians and others skilled in the art.

The first group 22 of air channels 18 and the second group 24 of air channels 18 can be organized into at least four distinct musical chords. Two chords are produced when blowing into the harmonica 10 and two chords are produced when drawing air from the harmonica 10. As the harmonica 10 allows a player to produce music during both the blowing and drawing of air, the first group 22 of air channels 18 is operable to produce a first musical chord when blowing air and a second musical chord when drawing air. Similarly, the second 24 group of air channels produces the musical tones of a third musical chord when blowing air and a fourth musical chord when drawing air.

Figure 4A:
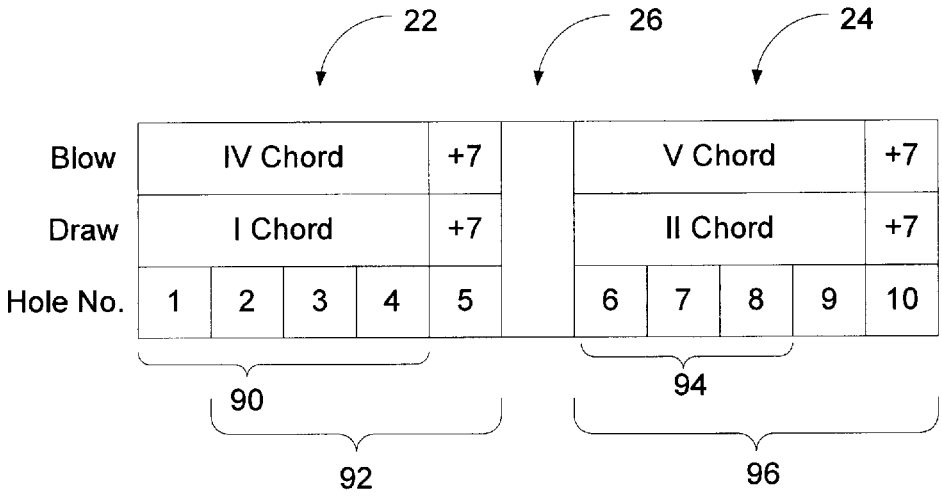
FIG. 4A shows a generic chord configuration table of a harmonica in accordance with an embodiment of the present invention.
Figure 4B:
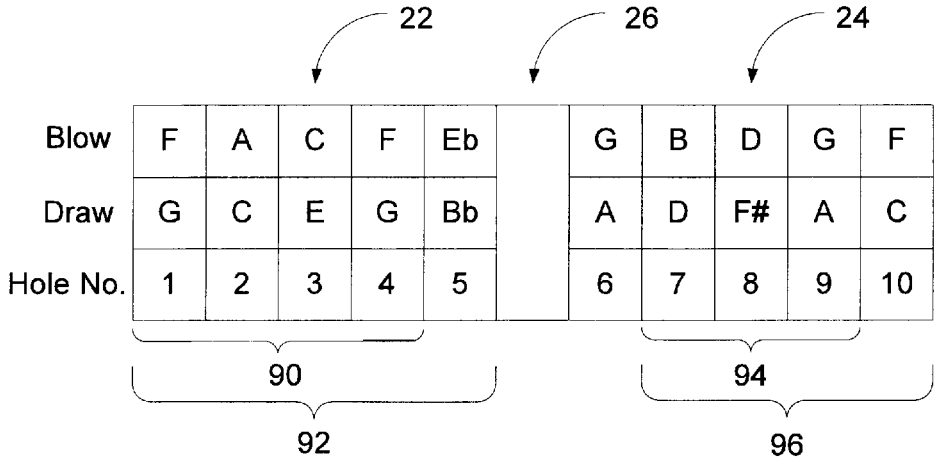
FIG. 4B shows the note layout configuration of a harmonica in a particular key (in the key of F), in accordance with an embodiment of the present invention.

Referring now to FIG. 4A and FIG. 4B, different arrangements and/or configurations of the harmonica 10 are shown in different embodiments. As illustrated in FIG. 4A, generic chords are produced when blowing air into the first group 22 of air channels 18 (the first musical chord), when drawing air from the first group 22 of air channels 18 (the second musical chord), when blowing air into the second group 24 of air channels 18 (the third musical chord) and when drawing air from the second group 24 of air channels 18 (the fourth musical chord). The generic chords are relative to a single musical key (e.g. key signature). Furthermore, the group divider 26 is shown in FIG. 4A and FIG. 4B to illustrate that the group divider 26 is configured to reduce the chance of playing musical notes from the other group. In FIG. 4B, a specific note layout configuration is shown. For example, the note layout configuration may be related to the chord configuration table seen in FIG. 4A. As illustrated in FIG. 4B, the harmonica 10 has a note layout configuration in the key F, and is configured to produce the chords identified in the chord configuration table seen in FIG. 4A.

As known to a person skilled in the art, a conventional harmonica is available in 12 different musical keys (i.e. G, G#, A, Bb, B, C, C#, D, Eb, E, F and F#). Low keys are available from some manufacturers and these are generally one octave lower than the standard keys (i.e. low F, low E, low Eb, low D, etc.) In any key, it is possible to play in any and all other keys on a single conventional diatonic harmonica. These are called 'positions". For example, when playing in the key of C Major on a "Key of C" harmonica, a player is playing in first position.

The different positions follow the commonly known circle of fifths. Accordingly, in the key of C harmonica, the positions and their related keys are:

$1^{st}$ position—key of C (straight harp)
$2^{nd}$ position—key of G (cross harp)
$3^{rd}$ position—key of D
$4^{th}$ position—key of A
etc.

Moreover, most blues, rock and country music is played in the second position. For example, on a C Harp (i.e. a conventional harmonica in the Key of C), most music is played in the key of G. Higher positions are possible, but higher positions are difficult to play in as many notes must be avoided and "bent" notes are necessary. Bending is a harmonica technique that is difficult for most beginning harmonica players.

As a conventional harmonica in the key of C is configured to play a C Major chord when blowing air and a G Major chord when drawing air, as seen in Table 1, a conventional harmonica is able to play a tonic chord in the first position (C Major chord) when blowing air and a tonic chord in the second position (G Major chord) when drawing air.

In a preferred embodiment, the harmonica 10 of the present invention is configured as two harmonicas in one. The group divider 26 separates the notes of the two conventional harmonicas. The first group 22 of air channels 18, corresponding to Hole No. 1 to 5, comprise the first harmonica and the second group 24 of air channels 18, corresponding to Hole No. 6 to 10, comprise the second harmonica. Both the first group 22 of air channels 18 and the second group 24 of air channels 18 are configured using Richter tuning.

The second group 24 of air channels may be configured in any key. However, in a preferred embodiment, the harmonica may incorporate the three major chords; namely the tonic chord (I), the subdominant chord (IV) and the dominant chord (V) when playing in the second position. For a harmonica 10 configured for the Key of F, the second position is C Major. In the key of C Major, the major chords are C (the tonic chord), F (the subdominant chord) and G (the dominant chord). Furthermore, the fourth musical chord may be any other chord or a repeat of one of the major chords. Accordingly, to incorporate the dominant chord (IV) when playing in C Major, the second group 24 of air channels 18, corresponding to Hole Nos. 6 to 10, may be configured for the key of G. In such embodiments, a G Major chord is played in the first position when blowing air into the harmonica 10 and a D Major chord is played in the second position when drawing air from the harmonica 10.

In an alternate embodiment, the second group 24 of air channels 18 may be configured for the key of C, such that a C Major cord is played in the first position when blowing air and a G Major chord is played in the second position when drawing air. Such an arrangement may allow the harmonica 10 to repeat the tonic (I) chord in a different octave.

It is also preferred that the two harmonicas defined by the first group 22 of air channels 18 and the second group 24 of air channels 18 are reasonably close in pitch. This may provide a desirable combination for smooth chordal transitions.

It should be understood that any other chord in the same musical key as the second position may be used, such as, for example, the tonic chord (I), the supertonic chord (II), the mediant chord (III), the subdominant chord (IV), the dominant chord (V), the submediant chord (VI) and the subtonic chord (VII).

As shown in FIG. 3A to FIG. 3E, the 10 air channels 18 are grouped into two groups 22, 24 of five air channels 18. As at least three musical notes are required to compose a musical chord as described herein, two additional notes may be used to supplement the at least four musical chords. The two additional notes may be used to produce tetrads (four note chords) and pentads (five note chords). In some instances, a repeat of one or more notes in the chord may be used. In alternate embodiments, the additional notes may be included to create additional chords.

In FIG. 4A, the first musical chord is the subdominant chord (IV) when blowing through a first subset 90 of the first group 22 of air channels 18. As illustrated, the first subset 90 is contiguous and only the first four notes (e.g 1, 2, 3, 4), as identified by Hole. No., are required to produce the subdominant (IV) chord. As further shown in FIG. 4B in the key of C Major, the subdominant (IV) chord is F Major and is composed of the notes: F, A, C. In FIG. 4B, the tonic note (an F note) may or may not be repeated when playing the subdominant chord.

Similarly, the tonic (I) chord, when air is drawn from the subset 90 of at least three contiguous air channels 18 of the first four air channels 18 (e.g. 1, 2, 3, 4), is composed of the notes: C, E, and G. As with the subdominant (IV) chord, one of the notes in the tonic (I) chord may be repeated to create a tetrad. However, in the case of the tonic (I) chord, the tonic note (a C note) is not repeated. Instead, a G note (a perfect fifth) is repeated to create a four-note inversion of the tonic (I) chord. Other inversions are also possible.

Similarly, in the embodiments shown in FIG. 4A and FIG. 4B, blowing or drawing air in a first subset 94 of the second group 24 of air channels 18 produces the dominant chord (V) and the supertonic (II) chord. As illustrated in the first subset 94 of the second group 24, the first subset is contiguous, but not all of the air channels 18 are required to produce the musical chord. Instead, the respective musical chord will be produced as long as all the required notes within the desired musical chord are produced, as known to musicians skilled in the art. For example, each of the major chords (I, IV, and V) requires three musical notes (the tonic, the perfect third and the perfect fifth).

In a preferred embodiment, the additional air channel 18 (e.g. Hole No. 5) in the first group 24 (or Hole No. 1, in other embodiments) may be used to supplement (i.e. enhance or add to) the subdominant (IV) chord when blowing air and the tonic (I) chord when drawing air. For example, as illustrated in FIG. 4A, the additional fifth note is indicated to be a relative seventh (+7) above the root of the chord. For example, the relative seventh (+7) may be a major seventh, a flat (minor) seventh, an augmented seventh or a diminished seventh. In a preferred embodiment, the fifth note may be a flat seventh (minor seventh) to make a dominant seventh chord (i.e. a major minor chord) when played with the major chord. Alternatively, the additional fifth note may be a major seventh to make a major seventh chord (i.e. major chord). As known in the art, major chords tend to sound "happier", while minor chords tend to sound more "sad". While a flat seventh is illustrated in the preferred embodiments seen in FIG. 4A and FIG. 4B, it should be understood that the additional note (e.g. Holes Nos. 5 and 10) may be a different note in alternate embodiments.

As seen in the embodiment illustrated in FIG. 4B, the additional note in the first group 22 (i.e. 5) and the additional note in the second group 24 (i.e. 10) are all flat sevenths of the respective chords. Accordingly, when the flat seventh notes (e.g. 5 and 10) are played (i.e. in the second subsets 92, 96 of the first and second groups 22, 24 of air channels 18) in addition to the first musical chord, the second musical chord, the third musical chord and the fourth musical chord, the respective chords are modified to become dominant seventh chords. As with the first subsets 90, 94, the second subsets 92, 96 are composed of contiguous air channels 18 within the first group 22 and the second group 24.

Referring to FIG. 4B, when at least the second through fifth notes (e.g. 2, 3, 4, 5) are blown at the same time, an F7 chord is produced (i.e. an F dominant seventh chord). The first note (e.g. Hole No. 1) may also be played as part of the F7 chord. Similarly, the C Major chord is modified to produce a C7 chord when the fifth additional note (e.g. Hole No. 5) is also drawn. As with the Major chords, various inversions may be produced when incorporating the additional note.

In FIG. 4B, Hole No. 5 is configured as an Eb when blowing air into the first group 22 of air channels 18. As Hole No. 4 is configured as an F note, Hole No. 5 is configured to be tuned down from an A note, according to Richter tuning, to an Eb note. This is a drop of six semitones. The inventor has appreciated that this layout change is radical, as conventional harmonicas do not have a drop in pitch when moving from left to right (i.e. from Hole No. 1 to 10). However, it has been discovered that the change is very effective.

A result from the change in Richter tuning is the loss of one note for additional diatonic or single note playing. However, as the harmonica 10 is configured for playing chords and as a chording instrument, adding the minor seventh to the harmonica on the blow adds the important dominant seventh chord for the subdominant (IV) chord (e.g. F and F7).

For the second group 24 of air channels 18, a similar approach to designing the second harmonica was taken. The G chord is modified to produce a G7 chord and the D chord is modified to produce a D7 chord when air is either blown through or drawn from the second subset 96 of the second group 24 of air channels 18 including the additional note. In this manner, the harmonica 10 is operable to play at least eight musical chords. For example, dependent on which contiguous air channels 18 air is blown into or drawn from, the harmonica 10 configured with the note arrangement of FIG. 4B is operable to play C, C7, D, D7, G, G7, D and D7. Or, more generically, in the key of C Major, the harmonica 10 is operable to play the relative chords I, $I^7$ (dominant seventh chord of the tonic chord), IV, $IV^7$ (dominant seventh chord of the subdominant chord), V, $V^7$ (dominant seventh chord of the dominant chord), II and $II^7$ (dominant seventh chord of the supertonic chord) when playing the harmonica 10 in second position. Other arrangements are also possible.

Referring now to FIG. 5A and FIG. 5B, FIG. 6A and FIG. 6B, and FIG. 7A and FIG. 7B, additional embodiments of the harmonica 10 are illustrated in specific keys. These keys C, G, and E should not be construed as limiting, as every key is possible.

In FIG. 5A and FIG. 5B, the harmonica is in the key of C Major when the first group 22 of air channels 18 is played in the second position. Accordingly, the first group 22 of air channels 18 is configured in the key of low F (using the standard key designation used with conventional diatonic harmonicas) and the second group 24 is configured in the key of G.

As seen in FIG. 5A, Hole Nos. 5 and 10 for the blow notes, corresponding to blow plate reed cells 32, are configured according to Richter tuning. In FIG. 5B, Hole Nos. 5 and 10 for the blow notes are adapted to play the flat seventh. Accordingly, in the embodiment illustrated in FIG. 5A, the harmonica 10 may maintain Richter tuning for the blow notes in the first group 22 and the second group 24 of air channels 18 to allow for additional melodies to be played using Richter tuning. In such embodiments, the harmonica 10 may be configured to play at least six chords (e.g. Low F, C, C7, D, D7 and G).

Alternatively, in the embodiment illustrated in FIG. 5B, the additional notes (e.g. Hole Nos. 5 and 10) are configured to play the flat seventh in order to produce the dominant seventh chord of both the subdominant (IV) and dominant (V) chords (e.g. F7 and G7, seen in FIG. 5B). In such embodiments, the harmonica 10 is configured to play at least eight chords (Low F, Low F7, C, C7, D, D7, G and G7).

As also shown in FIG. 5A and FIG. 5B, related "Band Chords" are provided. If the harmonica 10 is played with an accompanying band or background soundtrack, the provided band chords can be used to identify which band chords can be played with the respective draw or blow chords. For example, when a band is playing a chord in the key of C Major, a player using the harmonica 10 may also want to play a C Major chord. Similarly, while the harmonica 10 adapted according to the note configuration table in FIG. 5B is not configured to play any minor chords, the related minor of the C Major chord is also identified, as A minor 7 (Am7). While an Am7 is not produced by the harmonica 10, a C Major chord over an Am7 chord is very harmonious. As known to persons skilled in the art, the minor $3^{rd}$ of the Am7 is C, the $7^{th}$ is G and the $5^{th}$ is E. Accordingly, the Band Chords identified in FIG. 5A and FIG. 5B include the relative minor seventh chords of the respective blow and draw chords.

The inventor has appreciated that the keys of G Major and E Major are extremely popular in modern music. FIG. 6A and FIG. 6B show similar note configuration tables for a harmonica 10 for when the first group 22 is configured in the key of "Low C" and the second group 24 is configured in the key of "Low D" and the music produced in the second position is in the key of G Major. Similarly, FIG. 7A and FIG. 7B show similar note configuration tables for a harmonica 10 when the first group 22 is configured in the key of "A" and the second group 24 is configured in the key of "B" and the music produced in the second position is in the key of E Major.

It should be understood that other related musical chords are possible in other embodiments. Furthermore, the harmonica 10 may be configured to play in any musical key (i.e. key signature).

As illustrated, it should be recognized that using the harmonica 10 to play chords rather than individual notes requires a greater exertion of energy relative to playing individual notes. Playing chords comprising at least three musical notes requires deep breathing and significant lung exertion and lung capacity relative to simply playing a melody composed of individual notes. Furthermore, sustaining a note for a period of time or exhaling or inhaling a large volume of air to produce a loud, clear chord can be a significant exertion of energy and may be considered exercise for the lungs. Accordingly, the harmonica 10 may be used to improve the pulmonary function of the pulmonary system by incorporating the chords and chord progressions provided by the harmonica 10, described above. For example, adopting Chordal Jamming into a player's harmonica playing requires activation of not only the chest muscles or respiratory muscles, but also of the diaphragm in order to produce warm, rich tones.

Furthermore, playing the harmonica 10 may engage other aspects of the pulmonary system, including the internal and external intercostals muscles and other accessory muscles of respiration. Furthermore, playing the harmonica 10 adapted for Chordal Jamming may stretch the rib cage, improving lung capacity.

As described, the harmonica 10 of the present invention rearranges the notes on a conventional diatonic harmonica such that at least four distinct chords can be easily played by the harmonica player, while at the same time maintaining the capability of playing individual notes. In this manner, the harmonica player can utilize the harmonica 10 to play songs and rhythms using chord progressions, rather than simply relying on the melodies typically played on a conventional diatonic harmonica. As mentioned, such harmonica playing has been termed "Chordal Jamming".

A harmonica configured for Chordal Jamming may be easily learned by individuals of all ages. Furthermore, a harmonica configured for Chordal Jamming maintains the fun and musicality of playing the harmonica while providing a significant physiological challenge such that it may be used in pulmonary and other medical therapy. This may improve compliance for patients who would otherwise have difficulty learning to play a conventional harmonica and may otherwise become discouraged. For example, some patients may lack the tongue and mouth dexterity to play individual notes. However, they may be able to play at least three contiguous air channels 18 at the same time to produce one or more musical chords. Accordingly, a harmonica 10 configured for Chordal Jamming is a fun and effective way to improve the pulmonary system for patients across a wide range of ages.

While a conventional diatonic harmonica is often a lead instrument, playing the melody or harmony in a song; a harmonica configured for Chordal Jamming may be used to provide "the background music" instead of the melody. In other words, a harmonica configured for Chordal Jamming is operable as the chording instrument. In this manner, the harmonica becomes an instrument similar to the rhythm guitar or the organ in the band. In a preferred embodiment, a method of playing a harmonica 10 adapted for Chordal Jamming involves the patient/individual playing along with a "soundtrack" sometimes also called a "jam track", where the soundtrack or jam track provides the drums, bass, vocals, and/or various lead instruments (for example lead guitar, saxophone, etc.) while the patient/individual provides the chordal background and chordal rhythm with the harmonica 10. This may also allow patients to play in larger groups, as it is easier to maintain a chording rhythm or background music and/or harmonies across a wide range of user abilities.

Furthermore, as the harmonica 10 of the present invention has been adapted to play a wider range of chords than a conventional harmonica, a great range of music may be played with the harmonica 10. As known to many musicians, only three chords are required for a great deal of popular and classical music: the tonic (I) chord, the subdominant (IV) chord, and the dominant (V) chord. Chord progressions using these three musical chords can be used in different rhythms and patterns to play a wide selection of songs. Furthermore, with the addition of the relative major minor chords (i.e. $I^7$, $IV^7$, $V^7$) or other relative seventh chords and the like, an even wider range of music can be played.

For example, common chord progressions using the major chords include:

I-IV-V-V;

I-I-IV-V;

I-IV-I-V;

I-IV-V-IV; and the like.

Furthermore, the very common 12 Bar Blues pattern also utilizes a I, IV, V chord progression. As known to skilled musicians, Table 3 and Table 4 illustrate common 12 Bar Blues patterns using the tonic (I), subdominant (IV) and dominant (V) chords:

TABLE 3

| Common 12 Bar Blues Pattern | | | |
|---|---|---|---|
| I | I | I | I |
| IV | IV | I | I |
| V | IV | I | V |

TABLE 4

| Alternate 12 Bar Blues Pattern | | | |
|---|---|---|---|
| I | I | I | I |
| IV | IV | I | I |
| V | V | I | I |

A user may adopt any musical chord progression using the musical chords provided by the harmonica 10. The chord progressions may be played in any number of rhythms. Different types of chordal syncopation may be used to encourage and improve musicality. Furthermore, to obtain improvements in the pulmonary function of the pulmonary system, the music should include rhythms having long drawn out chords which are held for significant periods of time. For example, clinical practice has shown an improvement in pulmonary function with improvement of the strength of the muscles of respiration in patients who play aggressive rhythms played on a harmonica adapted for Chordal Jamming. Other evidence suggests at least abatement in the decline of pulmonary function.

Playing aggressive, fast rhythm exercises for only 20 to 30 seconds can lead to exhaustion and the feeling of "soreness", similar to that experienced after weight lifting. In playing long, drawn-out chords and aggressive rhythmic playing, a harmonica player is required to exert a significant amount of energy with excellent exercise of the pulmonary and related musculoskeletal systems. With chordal playing, it is not uncommon to move 4 to 6 L of air when progressing from a full inspiration to a full expiration. While such volumes of air are not required to produce pulmonary benefits, an effective volume of air being blown into or drawn from the harmonica 10 adapted for Chordal Jamming is required to exert the energy necessary to see improvement in the pulmonary system. The effective volume of air will vary by patient and may be about 2 L or greater.

Although the harmonica exercises have been designed to benefit primarily the pulmonary system, it has been observed that there are also significant cardiac effects, with similar increases in heart rate and blood pressure that are seen with cardiovascular exercise. A number of other non-pulmonary benefits have been observed and reported including: improvement in sleep apnoea, reduced snoring, improvement in neurological function (commonly used in treatment of patients with Parkinson's disease and various dementias), stress reduction, reduction in blood pressure, etc.

It should be understood that the air channels 18 may be grouped into more than two groups 22, 24. For example, with 10 air channels 18, an embodiment of the harmonica may have three groups, with two groupings of three air channels 18 and one grouping of four air channels 18. Alternate harmonicas may have additional air channels 18 to allow for additional musical chords. Such embodiments may further allow for musical key changes and the playing of additional complex compositions. The preferred embodiments described herein should not be construed as limiting.

Although this disclosure has described and illustrated certain preferred embodiments of the invention, it is also to be understood that the invention is not restricted to these particular embodiments rather, the invention includes all embodiments which are functional, or mechanical equivalents of the specific embodiments and features that have been described and illustrated herein.

It will be understood that, although various features of the invention have been described with respect to one or another of the embodiments of the invention, the various features and embodiments of the invention may be combined or used in conjunction with other features and embodiments of the invention as described and illustrated herein.

The embodiments of the invention in which an exclusive property or privilege is claimed is defined as follows:

1. A harmonica comprising:

a blow reed plate comprising a plurality of blow reed cells therein, wherein each blow reed cell is arranged on the blow reed plate and comprises a blow reed and a blow reed slot;

a draw reed plate comprising a plurality of draw reed cells therein, wherein each draw reed cell is arranged on the draw reed plate and comprises a draw reed and a draw reed slot;

a comb having a plurality of air channels therein, said comb positioned between the blow reed plate and the draw reed plate, wherein each of the plurality of air channels comprises a first side adjacent to one of the plurality of blow reed cells and a second side adjacent to one of the plurality of draw reed cells; and a housing comprising a top cover plate and a bottom cover plate, wherein the blow reed plate, the draw reed plate and the comb are disposed within the housing;

wherein each blow reed cell and each draw reed cell corresponds to one of a plurality of musical tones, wherein the plurality of air channels are grouped into a first group of air channels and a second group of air channels, wherein blowing air through a first subset of the first group of air channels produces the musical tones of a first musical chord and drawing air from the first subset of the first group of air channels produces the musical tones of a second musical chord, and wherein blowing air through a first subset of the second group of air channels produces the musical tones of a third musical chord and drawing air from the first subset of the second group of air channels produces the musical tones of a fourth musical chord.

2. The harmonica of claim 1, wherein the harmonica is a diatonic harmonica.

3. The harmonica of claim 1, wherein a first plurality of channel dividers having a channel dividing width separate the air channels in the first group of air channels from each other and a second plurality of channel dividers having the channel dividing width separate the air channels in the second group of air channels from each other; and wherein the first group of air channels and the second group of air channels are separated by a group divider having a group dividing width greater than the channel dividing width.

4. The harmonica of claim 3, wherein the group divider width is at least 10 mm.

5. The harmonica of claim 1, wherein the first musical chord, the second musical chord, the third musical chord and the fourth musical chord are from a single musical key.

6. The harmonica of claim 5, wherein each of the first musical chord, the second musical chord, the third musical chord and the fourth musical chord are one of: a tonic chord (I), a subdominant chord (IV), a dominant chord (V), and a supertonic chord (II) of the single musical key.

7. The harmonica of claim 6, wherein the single musical key is C Major, and wherein the first musical chord is an F chord, the second musical chord is a C chord, the third musical chord is a G chord and the fourth musical chord is a D chord.

8. The harmonica of claim 6, wherein the harmonica includes at least one of each of the tonic chord, the subdominant chord and the dominant chord of the single musical key.

9. The harmonica of claim 6, wherein blowing air through a second subset of the first group of air channels produces the musical tones of a fifth musical chord and drawing air from the second subset of the first plurality of air channels produces the musical tones of a sixth musical chord; and wherein blowing air through a second subset of the second plurality of air channels produces the musical tones of a seventh musical chord and drawing air from the second subset of the second plurality of air channels produces the musical tones of an eighth musical chord.

10. The harmonica of claim 9, wherein the second subset of the first group of air channels comprises the first subset of the first group of air channels and a first additional air channel of the first group of air channels; and wherein the second subset of the second group of air channels comprises the first subset of the second group of air channels and a second additional air channel of the second group of air channels.

11. The harmonica of claim 8, wherein the fifth musical chord is a relative seventh chord of the first musical chord;

wherein the sixth musical chord is a relative seventh chord of the second musical chord;

wherein the seventh musical chord is a relative seventh chord of the third musical chord; and wherein the eight musical chord is a relative seventh chord of the fourth musical chord.

12. The harmonica of claim 9, wherein the fifth musical chord is a relative seventh chord of the first musical chord;

wherein the sixth musical chord is a relative seventh chord of the second musical chord;

wherein the seventh musical chord is a relative seventh chord of the third musical chord; and wherein the eight musical chord is a relative seventh chord of the fourth musical chord.

13. The harmonica of claim 11, wherein the fifth chord, the sixth chord, the seventh chord and the eight chord are dominant seventh chords.

14. The harmonica of claim 12, wherein the fifth chord, the sixth chord, the seventh chord and the eight chord are dominant seventh chords.

15. A method of improving pulmonary function in a pulmonary system comprising:

providing a harmonica comprising a first plurality of air channels and a second plurality of air channels, wherein blowing air through a first subset of the first plurality of air channels produces a first musical chord, wherein drawing air from the first subset of the first plurality of air channels produces a second musical chord, wherein blowing air through a first subset of the second plurality of air channels produces a third musical chord, and wherein drawing air from the first subset of the second plurality of air channels produces a fourth musical chord;

blowing and drawing air at different times into the harmonica to play music composed of the first musical chord, the second musical chord, the third musical chord and the fourth musical chord;

exerting energy by the blowing and drawing of air into the harmonica at the different times to strengthen the pulmonary function of the pulmonary system.

16. The method of claim 15, wherein the music played on the harmonica comprises a plurality of musical chord progressions from a single musical key composed of the first musical chord, the second musical chord, the third musical chord and the fourth musical chord.

17. The method of claim 15, wherein the music played on the harmonica comprises a plurality of musical rhythms composed of the first musical chord, the second musical chord, the third musical chord and the fourth musical chord.

18. The method of claim 16, wherein an effective volume of air is used when playing the first musical chord, the second musical chord, the third musical chord and the fourth musical chord in the plurality of musical rhythms, to exert the energy to strengthen the pulmonary function of the pulmonary system.

* * * * *